United States Patent [19]

Browning

[11] Patent Number: 4,575,379

[45] Date of Patent: Mar. 11, 1986

[54] FUEL COMPOSITION AND METHOD OF PREPARATION THEREFOR

[76] Inventor: John M. Browning, 496 Stratford Ave., Elmhurst, Ill. 60126

[21] Appl. No.: 619,041

[22] Filed: Jun. 11, 1984

[51] Int. Cl.[4] ..... C10L 7/00

[52] U.S. Cl. ..... 44/7.4; 102/365; 252/315.3; 44/7.6

[58] Field of Search ..... 44/7.2, 7.4, 7.6, 7.7; 102/363, 365; 252/315.3; 149/2

[56] References Cited

U.S. PATENT DOCUMENTS

| | | | |
|---|---|---|---|
| 3,899,439 | 8/1975 | Mahlman | 252/315.3 X |
| 4,038,206 | 7/1977 | Karl | 252/315.3 X |
| 4,152,289 | 5/1979 | Griffin, Jr. | 44/7.6 X |
| 4,205,724 | 6/1980 | Swanson et al. | 252/315.3 X |
| 4,244,826 | 1/1981 | Swanson | 252/315.3 X |
| 4,302,208 | 11/1981 | Wood et al. | 44/7.6 |
| 4,439,328 | 3/1984 | Moity | 252/8.5 M X |

OTHER PUBLICATIONS

"Bermocoll TM —Cellulose Ethers", Brochure published by Berol Kemi AB of Stenungsund, Sweden.

*Primary Examiner*—Peter A. Nelson
*Attorney, Agent, or Firm*—Emrich & Dithmar

[57] ABSTRACT

A fuel composition in the form of a gel is particularly adapted for use in a fireplace or a heater and offers the advantages of increased stability, reduced burn rate, decreased noxious by-product generation, and enhanced safety. Comprised of a combination of water, alcohol and ethyl hydroxyethyl cellulose, the miscibility of these components is accomplished by lowering the pH of the mixture. Once in solution, the pH of the mixture is then raised to increase its viscosity in forming a stable gel. Various low carbon alcohols, or blends thereof, may be utilized to provide a range of combustion characteristics. In addition, various salts may be incorporated in the stable gel fuel to provide a desired flame characteristic.

13 Claims, 1 Drawing Figure

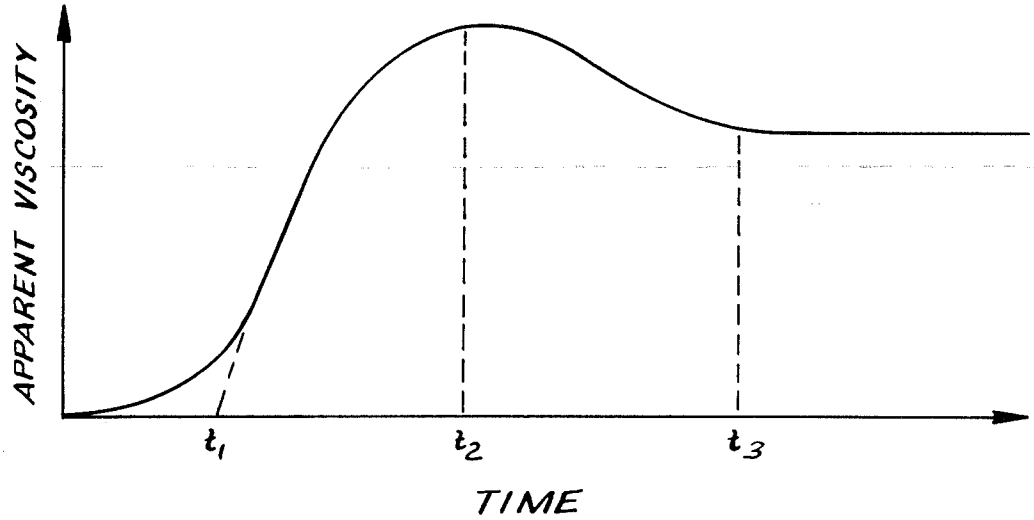
APPARENT VISCOSITY
$t_1$
$t_2$
$t_3$
TIME

FUEL COMPOSITION AND METHOD OF PREPARATION THEREFOR

BACKGROUND OF THE INVENTION

The present invention relates generally to combustible fuel compositions and is particularly directed to a fuel composition in the form of a gel for use in a fireplace.

The use of unvented fuel-fired space heaters has increased with the increase in the general cost of heating fuels. A portable unvented space heater is considerably more efficient than a central heating system fueled with oil or natural gas because of the capability to provide heat where needed while eliminating, or reducing, the heating of unused areas. Over the course of a heating season, it has been estimated that as much as half of the heat produced in a central heating system is wasted primarily through the system's chimney. By contrast, a kerosene heater delivers approximately 90% of its heat to its surroundings. The use of an efficient space heater in combination with a lowering of the thermostat of the central heating system is one of the most effective ways to save energy and money.

Various types of space heaters are currently available. Two of the more common space heaters currently in use are portable electric and kerosene heaters. In general, a kerosene heater is less expensive to operate because of the lower relative cost of its fuel. However, even the most sophisticated kerosene heaters suffer from various limitations such as pollution of the air including the emission of unpleasant odors, the generation of soot which may be deposited upon the walls and other surfaces of the room in which the heater is located, and the increased hazard inherent in using a flammable liquid.

Another type of heater gaining increased acceptance is the portable fireplace which offers several advantages over the kerosene-type heater. For example, many portable fireplaces possess the attractiveness of a conventional fireplace while offering 100% heat gain because of the absence of down drafts and chimney flue heat loss. In addition, portable fireplaces offer the attractiveness of a conventional fireplace and the heating flexibility of a conventional space heater. In spite of these advantages, portable fireplaces now in use suffer from many of the same shortcomings inherent in conventional kerosene space heaters. For example, precautions must be taken in the storage and handling of the liquid fuel. If spilled, the liquid fuel will burn readily if absorbed by a household item such as a rug, which acts as a wick. Attempts have been made, with varying degrees of success, to increase and provide a uniform viscosity of the fuel to reduce the spilling hazard and provide a uniform combustion rate. In addition, fuels currently used in portable fireplaces emit various hazardous substances including carbon monoxide, nitrous oxide, and sulfur dioxide at levels considered unacceptable by current safety standards. Finally, the cost of fuels used in portable fireplaces generally exceed the cost of kerosene and restrict the use of portable fireplaces as an alternative heating source.

The present invention is intended to overcome the aforementioned limitations and thus represents an improvement over the prior art. The fuel composition of the present invention is in the form of a gel and thus eliminates the hazards of a fuel spill while providing the capability to regulate the rate of fuel consumption and associated combustion characteristics. The fuel may be easily and inexpensively packaged in a fireproof container and conveniently used therein either in a fireplace, particularly of the portable type, for cooking, or for providing an attractive source of light. The number and extent of noxious combustion by-products is minimized and soot and ashes are completely eliminated.

OBJECTS AND SUMMARY OF THE INVENTION

Accordingly, it is an object of the present invention to provide an improved fuel for heating and cooking.

It is another object of the present invention to provide a combustible fuel particularly adapted for use in a fireplace which offers minimal noxious combustion by-products, a controllable burn rate, and a wide range of flame characteristics.

Yet another object of the present invention is to provide a low cost, conveniently packaged, and safe fireplace fuel.

A further object of the present invention is to provide a combustible fuel in a stable gel form which provides increased safety in storage, handling and use.

A still further object of the present invention is to provide a high alcohol content combustible fuel in a stable gel form.

It is a further object of the present invention to provide a fuel composition particularly adapted for indoor use which produces neither ashes nor smoke and is economical to use.

The present invention contemplates a combustible fuel comprised of alcohol, water and a cellulose ether in gel form. Miscibility is achieved by reducing the pH of the mixture below 7. By then increasing the pH above 7, a uniformly textured gel is formed at a rate determined by the pH value. Various lower carbon alcohols, and combinations thereof, may be employed to provide a desired flame characteristic and various salts may be added to similarly control flame color. In a preferred embodiment, ethyl hydroxyethyl cellulose is utilized to provide a low cost flammable fuel which is stable and conveniently packaged, stored and handled.

BRIEF DESCRIPTION OF THE DRAWING

The appended claims set forth those novel features which characterize the invention. However, the invention itself, as well as further objects and advantages thereof, will best be understood by reference to the following detailed description of a preferred embodiment taken in conjunction with the accompanying drawing, wherein is shown a viscosity curve for an aqueous solution to which is added ethyl hydroxyethyl cellulose in accordance with the present invention.

DETAILED DESCRIPTION OF THE PREFERRED EMBODIMENT

The present invention is directed to a fuel composition and method of preparation therefor. The fuel is a combustible fuel particularly adapted for use in a fireplace. However, the fuel of the present invention may also be used for the additional purposes of cooking or providing a decorative light source.

Preparation of the combustible fuel composition of the present invention begins with an aqueous alcohol solution. Various lower carbon alcohols, such as methanol, ethanol, propanol, isopropanol, etc., may be used. The alcohol utilized may be selected in accordance with the characteristics of the flame desired. For example, methanol provides a blue or a clear flame. Increasing the number of carbon atoms of the alcohol provides a more colorful flame. Thus, of the alcohols listed above, isopropanol provides the most colorful flame. In addition, the greater the amount of water in the aqueous alcohol solution, the cooler the flame produced and the longer the fuel will burn. Increasing the alcohol content of the aqueous alcohol solution will correspondingly increase the burn rate and provide a flame of increased heat intensity. In a preferred embodiment of the present invention, an aqueous solution containing 70% isopropanol is used.

The pH of the aqueous alcohol solution is then measured and adjusted to a value below 7. The pH of the aqueous alcohol solution may be lowered by adding virtually any acid in a conventional manner. In a preferred embodiment, the pH of the aqueous alcohol mixture is adjusted to a value of between 4 and 6 by adding trace amounts of hydrochloric (HCl) acid. The aqueous alcohol solution to which the acid is added is then mixed, or agitated, to fully disperse the acid in the mixture. Five minutes is typically required in order to achieve complete mixture of the acid and aqueous alcohol solution in adjusting the pH value thereof to within the desired value range.

Once the pH of the aqueous alcohol solution has been adjusted to within the aforementioned pH range, a cellulose ether is added to the mixture for dissolution therein. In a preferred embodiment, ethyl hydroxyethyl cellulose (EHC) in powder form is added to the aqueous alcohol solution. The solution is then further agitated in order to effect dispersion of the EHC throughout the aqueous alcohol solution. The grains of the EHC swell in the water before they dissolve oausing an increase in the viscosity of the solution. This can be seen in the Figure wherein is illustrated the change in apparent viscosity of an aqueous solution at various times following the addition of EHC thereto. In the Figure, $t_1$ represents the time at which the swelling of the grains of the EHC causes the viscosity of the solution to increase. Maximum swelling of the EHC grains occurs at $t_2$, while the final viscosity of the solution, or perfect dissolution of the EHC, is achieved at $t_3$. Various times indicated in the Figure may be controlled by selectively varying the pH value of the solution. For example, increasing the acid additive in the mixture will decrease the EHC dissolution rate, while alkaline additives tend to increase the EHC dissolution rate. In order to maintain the pH value at a desired level throughout the EHC dissolving period, the additives to the aqueous alcohol solution of EHC should have a good buffer capacity. In referring to the Figure, $t_2$ in a preferred embodiment is approximately 100 minutes where approximately 3% by weight of EHC is added to the aqueous alcohol solution. The amount of EHC added to the aqueous alcohol solution may vary from 2% for lower carbon alcohols and higher water concentration to 4% for higher carbon alcohols and lower water concentration.

The EHC may also be initially added to the alcohol and the slurry thus produced then added to the water. This pre-wetting of the EHC facilitates its dissolution in the water. In another arrangement, the EHC may be provided in an alcohol-water soluble shell which is added to the aqueous alcohol mixture. Following dissolution of the outer shell, the EHC then dissolves in the solution at a rate dependent upon the pH of the solution.

With the EHC dissolved in the aqueous alcohol solution, the pH of the solution is then increased to a value greater than 7 by the addition of a base in order to form a gel. The viscosity of the solution will increase without the addition of a base, but the rate at which a gel is formed can be adjusted by appropriate control of the pH of the solution. For example, increasing the pH to a value of 8.5 results in the formation of a gel within 8 minutes. In a commercial environment, however, it may be desirable to use a lower pH to permit additional time for formation of the gel for packaging purposes. For example, increasing the pH to a value of only 7 will result in the formation of a gel in approximately 40 minutes. In addition, if hydrochloric acid is used in the earlier described step of reducing the pH of the aqueous alcohol solution, a base containing sodium, such as sodium hydroxide or sodium bicarbonate, would be preferred in the subsequent step of increasing the solution's pH in order to precipitate out the chlorine in the form of a harmless salt (NaCl) which, in turn, adds color to the flame of the thus formed combustible fuel.

Prior to adding the base to the EHC and aqueous alcohol solution, various metal salts may be added to provide a desired flame characteristic for the thus formed fuel composition. For example, addition of a strontium salt will result in a bright red flame. Addition of a barium salt will produce a green flame. The addition of sodium, such as in the aformentioned forms of sodium hydroxide or sodium bicarbonate, will not only reduce the noxious effects of the chlorine in the solution, but will also provide a yellowish orange flame. Various combinations of the aforementioned salts may be added to the fuel composition of the present invention to impart a variety of desired flame characteristics thereto. In addition, various well known masking agents, or odorizers, may be added to the fuel composition prior to formation of the gel form thereof in order to provide a desired fragrance during combustion of the fuel composition.

The present invention thus provides an improved fuel composition and method of preparation therefor. The gel form of the fuel composition of the present invention offers various advantages such as a retarding of fuel evaporation particularly with respect to alcohol-based fuels, increased safety due to the elimination of spill hazards, and a controllable burn rate as determined by the amount of alcohol in the fuel. Reduced amounts of alcohol will result in lower combustion temperatures and reduced burn rates. In addition, the present invention provides a fuel in gel form having a uniform viscosity throughout which also ensures a more uniform burn rate throughout combustion of the entire fuel sample. In a preferred embodiment, the EHC is in the form of a powder having a particle size 98% $<0.3$ mm (98% through US mesh No. 50) and is treated for fast dispersing and an adjustable dissolving rate. EHC for use in the present invention is available from Berol Kemi AB of Sweden under the tradename "BERMOCOLL E."

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A method for forming a combustible fuel gel comprising the steps of:

forming an aqueous alcohol solution;

adjusting the pH of said aqueous alcohol solution to a value less than 7;

adding a cellulose ether to said pH-adjusted aqueous alcohol solution;

mixing the cellulose ether aqueous alcohol solution; and increasing the pH of the cellulose ether aqueous alcohol solution to a value above 7 in forming said combustible fuel gel.

2. The method of claim 1 wherein said cellulose ether comprises ethyl hydroxyethyl cellulose.

3. The method of claim 2 wherein said ethyl hydroxyethyl cellulose comprises between 2% and 4% by weight of said aqueous alcohol solution.

4. The method of claim 1 wherein the step of adjusting the pH of said aqueous alcohol solution to a value in the range of 4 to 6 comprises adding an acid thereto.

5. The method of claim 4 wherein the pH of said aqueous alcohol solution is adjusted to a value in the range of 4 to 6 by adding trace amounts of hydrochloric acid thereto.

6. The method of claim 5 wherein the step of increasing the pH of said cellulose ether aqueous alcohol solution comprises adding a base containing sodium thereto.

7. The method of claim 1 wherein the pH of said cellulose ether aqueous alcohol solution is increased to a value in the range of 7 to 8.5.

8. The method of claim 1 wherein said aqueous alcohol solution includes a low carbon alcohol.

9. The method of claim 8 wherein said aqueous alcohol solution includes methanol, ethanol, propanol, or isopropanol.

10. The method of claim 1 wherein said aqueous alcohol solution includes a combination of low carbon alcohols.

11. The method of claim 1 further comprising the step of adding a metal salt to the cellulose ether aqueous alcohol solution during the mixing thereof.

12. A combustible fuel in gel form comprising:

a low carbon alcohol;

water added to said alcohol to form an aqueous alcohol solution;

an acid added to the aqueous alcohol solution to reduce the pH thereof below 7;

a cellulose ether added to the pH-reduced aqueous alcohol solution; and a base added to the cellulose ether aqueous alcohol solution to increase the pH thereof above 7 in forming a gel.

13. The method of claim 1 wherein the pH of said aqueous alcohol solution is adjusted to a value in the range of 4 to 6.

* * * * *

UNITED STATES PATENT AND TRADEMARK OFFICE

CERTIFICATE OF CORRECTION

PATENT NO. : 4,575,379

DATED : March 11, 1986

INVENTOR(S) : John M. Browning

It is certified that error appears in the above—identified patent and that said Letters Patent is hereby corrected as shown below:

Column 3, line 35, "oausing" should be -- causing --.

Column 5, line 25 "claim 1" should be -- claim 13 --.

Signed and Sealed this

*Seventeenth* Day of *June 1986*

[SEAL]

*Attest:*

DONALD J. QUIGG

*Attesting Officer*

*Commissioner of Patents and Trademarks*